United States Patent [19]

Garlichs et al.

[11] Patent Number: 4,764,073

[45] Date of Patent: Aug. 16, 1988

[54] BOOK CASE MAGAZINE FOR BOOK CASING MACHINES

[75] Inventors: Siemen Garlichs, Espelkamp; Helmut Kolkhorst; Gerhard Franke, both of Rahden, all of Fed. Rep. of Germany

[73] Assignee: Kolbus GmbH & Co. KG, Rahden, Fed. Rep. of Germany

[21] Appl. No.: 40,940

[22] Filed: Apr. 21, 1987

[30] Foreign Application Priority Data

Apr. 26, 1986 [DE] Fed. Rep. of Germany ..... 3614216

[51] Int. Cl.[4] ..... B42C 7/00

[52] U.S. Cl. ..... 412/9; 493/478

[58] Field of Search ..... 412/3, 7, 9, 17; 493/478, 479

[56] References Cited

U.S. PATENT DOCUMENTS 2,583,712 1/1952 Shields ..... 493/479 X 3,408,907 11/1968 Gellatly ..... 493/478 X 4,043,235 8/1977 Miyamoto ..... 412/9 X

*Primary Examiner*—Paul A. Bell

*Attorney, Agent, or Firm*—Chilton, Alix & Van Kirk

[57] ABSTRACT

The invention relates to a book case magazine for book casing machines, this magazine comprising a device for picking off that book case which, at a given point in time, is lying flat at the bottom of a stack, and for conveying it away. The transport elements for conveying the book case are configured as wide feeders 5, 6, extending from the vicinity of a central support surface 59 for the stack and running laterally at least as far as the mid-regions of the covers of a book case that is representative of the largest format to be accomodated by the magazine. The feeders 5, 6 are mounted on a crossbeam 4 which can be moved forwards and backwards, enabling them to be set conjointly to the book case height, and wherein these feeders 5, 6 are preferably interconnected to form a single component, and can be set conjointly to the book case thickness by means of an adjusting mechanism 9.

23 Claims, 3 Drawing Sheets

BOOK CASE MAGAZINE FOR BOOK CASING MACHINES

BACKGROUND OF THE INVENTION

The present invention relates to a book case magazine for book casing machine.

With a book case magazine of the type in common use, changing over to a different book case format can be carried out only at a relatively high cost, in terms of both labor and time, owing to the need to make manual adjustments to a large number of components. Thus, whenever a format change is carried out, the transport elements, which serve both to engage behind the book cases and to convey them away, must be individually set to the mid-regions of the two book covers. Each must also be adjusted, upwards or downwards, to suit the book case thickness. Furthermore, the transport elements must be aligned with the rear boundary of the magazine, and this rear boundary must itself be set to the book case height.

The components which form the two lateral boundaries of the magazine must be set to the book case width in question, the stop strips must be set, as the front boundary, and the support rollers, which are located below the stop strips, must be set so that there is a gap between them and the strips. When making this latter adjustment, it is necessary to ensure that the stop strips and support rollers are also aligned with the mid-regions of the two book covers.

The stop strips and support rollers form a through passage for the book case, which has to be adjustable in order to prevent two cases from ever being withdrawn at the same time. This requires that the stop strips be adjusted, upwards or downwards, to suit the book case thickness, the height of the through passage corresponding to approximately 1½ times the thickness of the particular book cases which are to be picked off one by one.

The change-over operations that have just been described are performed manually, as has already been mentioned, and they are performed solely by trained personnel, which is obviously very time-consuming and expensive. Lastly, the impossibility of avoiding readjustments is a further disadvantage.

Book case magazines of this generic type employ relatively narrow transport elements, which invite the risk of failing to engage behind the book case, or of engaging behind it on one side only, this problem being attributable to sagging, which invariably occurs, and the more so when large-format cases are being handled. Malfunctions of this kind lead to stoppages, and consequently cause interruptions in production, which may be more than trivial.

SUMMARY OF THE INVENTION

The object of the invention is to provide a book case magazine, which, while being of the abovementioned generic type in some respects, is nevertheless capable of reliable operation without requiring more than a minimal amount of time per change-over, thus minimizing labor costs.

This object is achieved, according to the invention, by means of a design wherein the transport elements in a book case magazine of this generic type are configured as wide feeders, extending from the vicinity of the lowermost central support surface of the magazine and running outwards along the case width direction at least as far as the mid-regions of the covers of a book case that is representative of the largest format. The feeders are mounted on a crossbeam which can be moved forwards and backwards, and which enables them to be set conjointly to the book case height. The feeders are preferably interconnected to form a single component, and can be set conjointly to the book case thickness by means of an adjusting mechanism.

BRIEF DESCRIPTION OF THE DRAWINGS

In the paragraphs which follow, the invention is described by reference both an illustrative embodiment and to the drawings, in which.

DESCRIPTION OF THE PREFERRED EMBODIMENT

The present invention is a magazine designed for picking off that book case which, at a given point in time, is lying flat at the bottom of a stack, and for conveying it away. These operations are accomplished with the aid of transport elements which can be moved forwards and backwards, which engage behind the covers of a book case, which are associated with forward located surfaces for supporting the rear region of the stack of book case, and which are vertically adjustable in relation to these supporting surfaces. There are further included a central support surface that supports the stack of book cases, and additional support rollers which are aligned with the mid-regions of the book covers and support the front region of the stack of book cases. These support rollers are associated with front-mounted stop strips which are located above them and can be adjusted in relation to them, upwards or downwards, thus creating a through passage for just one book case at a time. Adjusting mechanisms for setting the support rollers, the stop strips, the rear wall, the sidewalls and the transport elements to suit the book case format in question are also provided.

Figure 1:
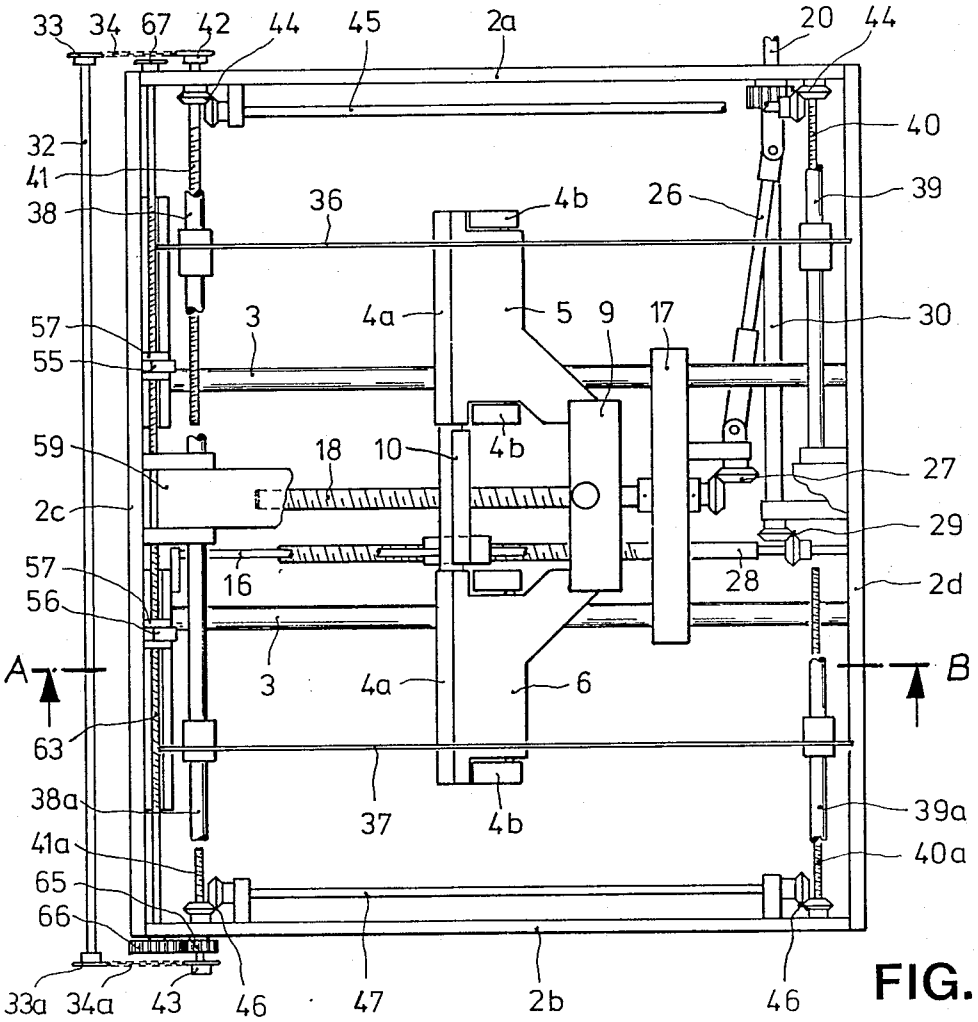
FIG. 1 shows the book case magazine, in a plan view.
Figure 2:
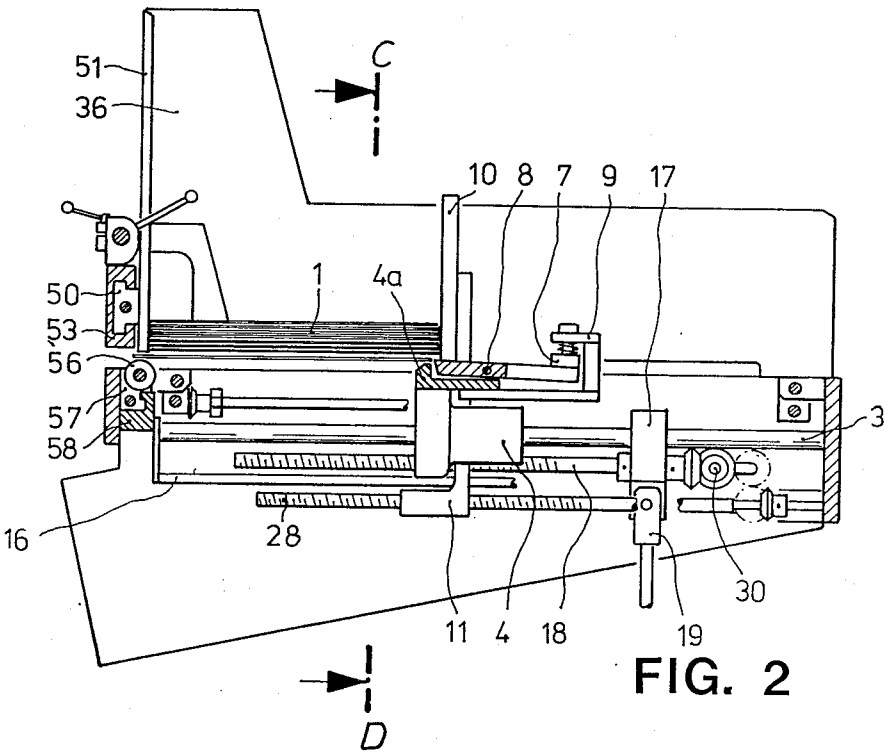
FIG. 2 shows a sectioned representation, along the line marked A - B in FIG. 1.
Figure 3:
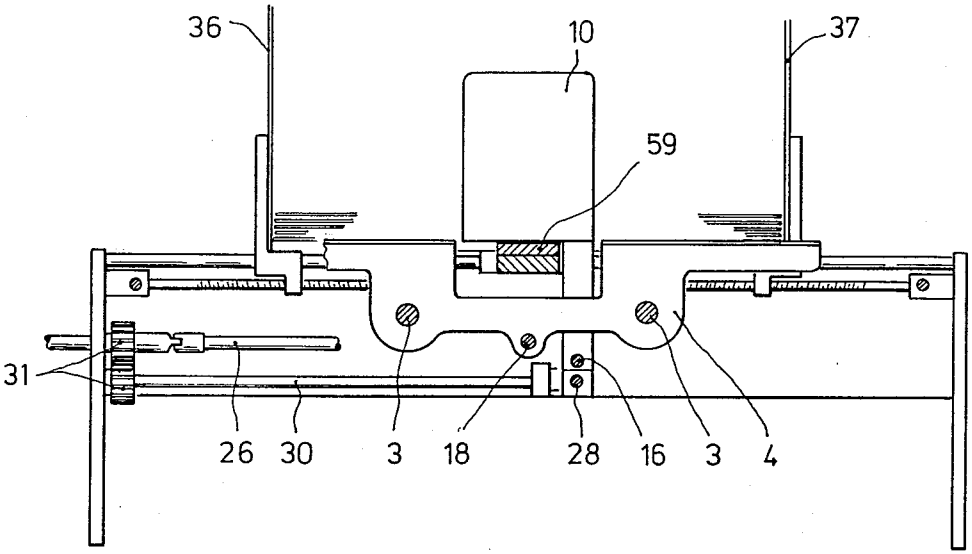
FIG. 3 shows a sectioned representation, along the line marked C - D in FIG. 2.

As shown in FIGS. 1–3, the book case magazine possesses a generally rectangular supporting frame, with side, front and rear members 2*a*–2*d*, and two guide rods 3 which are located between the front and rear members 2*c*, 2*d*, and on which a crossbeam 4 is slidably mounted. This crossbeam 4 possesses upward-pointing projections, which run laterally (i.e. side to side) and form a pair of spaced apart supporting surfaces 4*a* that serve to support the bottom of the rear region of a stack of book cases 1. The crossbeam 4 is furnished with two pairs of inset bearing blocks 4*b* which serve as mountings for the attachment of two laterally spaced apart feeders 5, 6, in a manner such that the feeders can pivot vertically about axis 8. The feeders 5, 6 are vertically adjustable in relation to the supporting surfaces 4*a*, so as to ensure that the front surface of each feeder unfailingly engages behind the single, lowest book case 1 that must be picked off and conveyed away at any one time.

The two feeders 5, 6 are rigidly interconnected by a bridge 7, to form a single component that can be pivoted about axis 8 by means of an adjusting mechanism 9 which is fastened to the crossbeam 4 and is adjustable through a biased, threaded bolt interacting with the bridge 7.

The two feeders 5, 6 are configured as wide, wing-like plate elements, which, when displaced forwardly, will straddle the central bar or similar surface 59 that supports the book case stack. The feeders 5, 6 run outwards along the width dimension of the case at least as far as the mid-regions of the covers of a book case that is representative of the largest format to be handled by the magazine. This configuration ensures reliable engagement behind book cases of any format which may have to be accommodated, without having to set the feeders 5, 6 to suit each particular case width.

A rear wall 10 is located in the space between the two feeders 5, 6 and the supporting surfaces 4*a*, this wall being mounted on a supporting part 11 that can be slid on guide rods 16 between the front and rear frame members 2*c*, 2*d*, and lying flush with the feeders 5, 6 when they are in their starting position.

In order to pick off that book case 1 which, lying flat, is lowest at any given point in time, the two feeders 5, 6, mounted on the crossbeam 4, are moved forwards and backwards, together with the supporting surfaces 4*a* that are assigned to them. Like the feeders 5, 6, the support surface 4*a* straddle the central support surface 59 during such movement. In addition, a crossmember 17 is located on the guide rods 3 that also carry the crossbeam 4, this crossmember 17 possessing an adjusting spindle 18 which is mounted parallel to the rods 3 in a manner such that it can be rotated, but cannot move axially, and which fits into a threaded central portion of the U-shaped crossbeam 4 below the level of the support surface 59. A push rod 19 is articulated to the crossmember 17, this rod 19 serving as the transmission means whereby a motor (not shown in the drawing) causes the crossbeam 4 and, in consequence, the feeders 5, 6 to execute their cyclic propelling movements.

For format height changing, the two feeders 5, 6, the supporting surfaces 4*a* and the rear wall 10 can all be moved forwards or backwards by means of a drive that is transmitted from a common drive shaft 20. In addition, this drive is transmitted, from the drive shaft 20, directly to a shaft 26 that incorporates a sliding joint, enabling the crossbeam 4 to be propelled via a pair of bevel gears 27. For adjusting the position of the rear wall 10, an adjusting spindle 28 fits into a threaded portion of the supporting part 11, this spindle 28 being indirectly coupled to the drive shaft 20 via a pair of bevel gears 29, the shaft 30, and a pair of spur gears 31.

The width of the book case magazine is defined by the sidewalls 36, 37, which are slidably mounted on front and rear support rods 38, 38*a* and 39, 39*a* and are positioned by means of threaded portions that fit separate adjusting spindles 41, 41*a* and 40, 40*a* at the front and rear respectively, these adjusting spindles being carried in the side members 2*a*, 2*b*.

A main drive shaft 32 is provided in order to enable the sidewalls 36, 37 to be adjusted conjointly, this drive shaft 32 extending across the entire width of the magazine and driving both the chainwheel 42 for moving one sidewall 36 and the chainwheel 43 for moving the opposite sidewall 37, via the chainwheels 33, 33*a* and the chains 34, 34*a*, the adjusting spindles 40, 41 being coupled together via pairs of bevel gears 44, while the connecting shaft 45 and the adjusting spindles 40*a*, 41*a* are coupled together via further pairs of bevel gears 46 and the connecting shaft 47.

Figure 4:
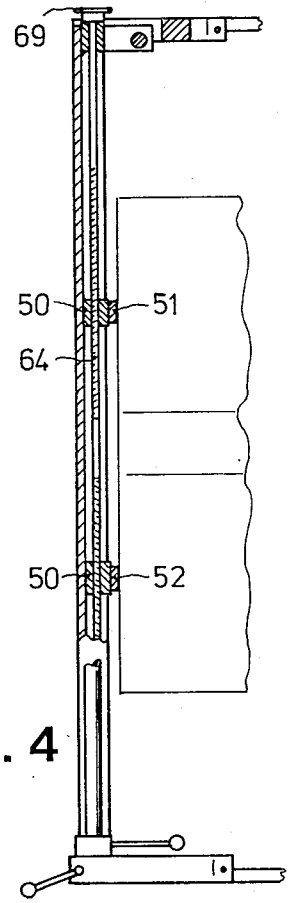
FIG. 4 shows a sectioned representation, in elevation, of the front portion of the magazine.
Figure 5:
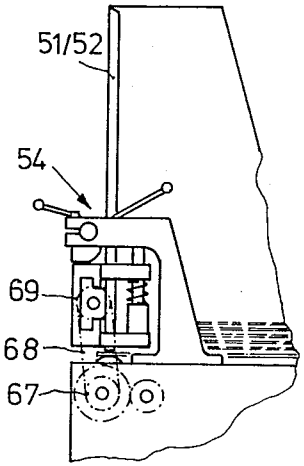
FIG. 5 shows a detail representation of the mechanism for adjusting the vertical position of the stop strips that form the front boundary of the magazine.

As shown particularly in FIGS. 4 and 5, the front boundary of the book case magazine is formed by two stop strips 51, 52 which are mounted in a manner permitting transverse sliding, by means of T-shaped sliders 50 in a T-slot guide 53 that is retained by the side members 2*a*, 2*b* of the supporting frame, and which can be adjusted, upwards or downwards, conjointly with the guide 53, so as to alter the height of the through-passage to accommodate the thickness of the book case. This adjustment is effected by an adjusting mechanism 54. Support rollers 55, 56 are located below the two stop strips 51, 52 and, with these strips, form the through-passage for the book case 1 that is to be picked off and conveyed away, the gap between the strips and the rollers being adjusted to 1½ times the book case thickness.

The support rollers 55, 56 can be slid transversely, in the same way as the stop strips 51, 52, and are thus installed in sliders 57 which fit into a correspondingly shaped guide track 58 associated with the side member 2*c* at the front of the magazine.

The magazine possesses a heated, centralling-located support bar or plate 59, which forms its lower boundary and therefore serves to support the stack of book cases, this support plate 59 extending in the longitudinal direction and lying at one and the same level as the two support rollers 55, 56 and the supporting surfaces 4*a* that belong to the crossbeam 4.

The support rollers 55, 56 are set to the mid-regions of the two book covers by means of an adjusting spindle 63 which is mounted in the side members 2*a*, 2*b*, and onto which each slider 57 fits by virtue of possessing a threaded portion. The slider 50 which serve as mountings for the stop strips 51, 52 likewise carry threaded portions, which fit onto an adjusting spindle 64.

A spur gear 65 is carried on the adjusting spindle 41*a*, outside the supporting frame, and meshes with a spur gear 66 on the adjusting spindle 63, giving a transmission ratio of 1:2. On the opposite side, a chainwheel 67 is located on the adjusting spindle 63, and drives a chainwheel 69 on the adjusting spindle 64, via a chain 68, so as to slide the stop strips 51, 52 in the transverse direction.

As is evident from the preceding description, the sidewalls 36, 37, the support rollers 55, 56 and the stop strips 51, 52 are conjointly set to the appropriate book case format by means of drives that are transmitted from a main drive shaft 32, this mechanism ensuring, by reason of the transmission ratio between the gears 65, 66, as chosen here, that the support rollers 55, 56 and the stop strips 51, 52 will at all times be aligned with the mid-regions of the book covers. Elements serving to define lateral boundaries in downline work stations, to which the book cases are individually conveyed, can be set to the appropriate width concurrently with the adjustment of the side parts 36, 37, these downline adjustments being effected by means of drives that are not shown in the drawings.

We claim:

1. A book case magazine for a book casing machine, said magazine comprising:

a frame having opposed side frame members and opposed front and rear frame members;

first lower support means extending in the direction from the front frame member toward the rear frame member, for supporting the bottom of a vertical stack of book cases lying flat on top of one another, each book case having a central portion and a pair of covers on either side of the central portion, the covers defining a width in the direction between the side members and a height in the direction between the front and rear members, and a vertical thickness, said support means extending along the central portion of the lowermost book case;

second lower support means associated with the front frame member, on either side of the lower support means, aligned for supporting the mid regions of the respective covers;

vertically extending front support means associated with the front frame member for defining a front stop limit for the stack of book cases;

a rear wall intermediate the front support means and the rear frame member, cooperating with the front support means for supporting the stack of book cases along the direction of their height;

a pair of side walls intermediate the frame side members, for supporting the stack of book cases along the direction of their width;

means for adjusting the second lower support means vertically relative to the front support means, to create a through passage for a single book case to be transported out of the frame front member;

means for adjusting the second lower support means in the cover width direction, to maintain said alignment for supporting the mid regions of the respective covers;

means for adjusting the distance between said side walls;

means for adjusting the distance between said rear wall and said front support means;

means for conjointly actuating said means for adjusting the second lower support means and said means for adjusting the distance between said side walls; and a transport mechanism, including:

(a) a feeder member extending parallel to the rear wall a distance at least as far as the distance between the mid regions of the covers, corresponding to the largest book format to be accommodated by the magazine, (b) a cross member mounted for controlled cyclical movement frontward and rearward within the frame, said feeder member being mounted on said cross member, (c) means for adjusting the feeder member commensurate with the book case height, (d) means for vertically adjusting the feeder member relative to the cross member commensurate with the thickness of the book case, (e) means for cyclicly driving the cross member forward and backward whereby said feeder member expels the lowermost book case through said passage.

2. The book case magazine in claim 1 wherein the second lower support means comprises a pair of spaced apart rollers and the front support means comprises a pair of vertically extending bars.

3. The book case magazine of claim 2 wherein said means for conjointly actuating also adjusts the distance between the bars of the upper support means with the adjustment of the second lower support means and the side walls.

4. The book case magazine of claim 1, further including means for conjointly actuating the means for adjusting the feeder member commensurate with the book case height and the means for adjusting the rear wall.

5. The book case magazine of claim 1 wherein the cross member and the feeder member straddle said first lower support means as the cross member is cycled frontward and rearward.

6. The book case magazine of claim 5 wherein the feeder member comprises two generally flat, wing-like plates on either side of said rear wall, said plates rigidly connected together to form a single component.

7. The book case magazine of claim 6 wherein the front surface of the feeder member and the front surface of the wall are substantially coplanar when the cross member is in rearmost cycled position, and wherein the means for adjusting the distance between said rear walls and said front support means include said means for adjusting the feeder member commensurate with the book case height.

8. The book case magazine of claim 7 wherein the cross member has an upper surface extending parallel to and of substantially the same length as the front surface of said feeder member, said cross beam upper surface being located forward of the feeder front surface and serving to support the rear underside of the stack of book cases.

9. The book case magazine of claim 8 wherein said second lower support means and said vertically extending front support means are each in pairs located on either side of said first lower support means and vertically aligned with each other, and wherein said means for adjusting the distance between said side walls further includes means for adjusting the distance between said pairs of support means whereby said second lower support means, said vertically extending support means, and said means for adjusting the distance between said side walls are conjointly adjustable through a common drive shaft.

10. The book case magazine of claim 9 wherein the second lower support means and the vertically extending front support means are coupled such that as they are adjusted to maintain their alignment with the mid region of the book covers, the adjustment travel distance corresponds to half the travel distance over which the side walls are adjusted by the action of said common drive shaft.

11. The book case magazine of claim 10, further including means coupled to said common drive shaft for adjusting the spatial relationship of components in another machine downstream of said bookcase magazine, automatically upon the adjustment of said second lower support means, said vertically extending front support means, and said side walls.

12. The book case magazine of claim 1, wherein said first lower support means is a bar;

said second lower support comprises a pair of rollers spaced on either side of the bar; and wherein said vertically extending front support means are a pair of stop members located respectively directly above said second lower support means.

13. The book case magazine of claim 12 wherein the cross member and the feeder member straddle said bar as the cross member is cycled forward and backward.

14. The book case magazine of claim 13 wherein the feeder member comprises two generally flat, wing-like plates on either side of said rear wall, said plates rigidly connected together to form a single component.

15. The book case magazine of claim 14 wherein the front surface of the feeder member and the front surface of the wall are substantially coplanar when the cross member is in rearmost cycled position, and wherein the means for adjusting the distance between said rear walls and said front support means include said means for adjusting the feeder member commensurate with the book case height.

16. The book case magazine of claim 15 wherein the cross member has an upper surface extending parallel to and of substantially the same length as the front surface of said feeder member, said cross beam upper surface being located forward of the feeder front surface and serving to support the rear underside of the stack of book cases.

17. The book case magazine of claim 16 wherein said means for vertically adjusting the feeder member relative to the cross member include, (a) at least one pair of bearing members extending vertically from the cross member, (b) a rod spanning each pair of bearing members, each rod traversing one of the feeder members, whereby each feeder member can pivot vertically about one of said rods.

18. The book case magazine of claim 17 wherein the rigid connection between the wing plates includes a bridge between the plates, and means interacting between said bridge and the upper surface of said wing plates rearward of said pivot rod, for adjusting the pivot angle of the plates relative to the cross member.

19. The book case magazine of claim 12 wherein said cross member has a central cut-out portion for passing under said bar as the cross member is cycled, and wherein each of said feeder member plates extends laterally on either side of said cut-out portion, of the cross member.

20. The book case magazine of claim 19 wherein said rear wall extends upwardly above said cut out in the cross member.

21. The book case magazine of claim 20 wherein the front surface of the feeder member and the front surface of the wall are substantially coplanar when the cross member is in rearmost cycled position, and wherein the means for adjusting the distance between said rear walls and said front support means include said means for adjusting the feeder member commensurate with the book case height.

22. The book case magazine of claim 21 wherein the cross member has an upper surface extending parallel to and of substantially the same length as the front surface of said feeder member, said cross beam upper surface being located forward of the feeder front surface and serving to support the rear underside of the stack of book cases.

23. The book case magazine of claim 22 wherein said second lower support means and said vertically extending front support means are each in pairs located on either side of said first lower support means and vertically aligned with each other, and wherein said means for adjusting the distance between said side walls further includes means for adjusting the distance between said pairs of support means whereby said second lower support means, said vertically extending support means, and said means for adjusting the distance between said side walls are conjointly adjustable through a common drive shaft.

* * * * *